United States Patent [19]

Fielding

[11] 4,447,095

[45] May 8, 1984

[54] SELF-LEVELING DRAWER SLIDE

[75] Inventor: Brian S. Fielding, Chappaqua, N.Y.

[73] Assignee: Hardware Designers, Inc., Mt. Kisco, N.Y.

[21] Appl. No.: 389,670

[22] Filed: Jun. 18, 1982

[51] Int. Cl.[3] ..... A47B 88/00

[52] U.S. Cl. ..... 308/3.8; 312/341 R

[58] Field of Search ..... 308/3.6, 3.8; 312/330, 312/333, 334, 343, 344, 345, 340, 341, 348, 342; 52/734, 73; 29/155 R

[56] References Cited

U.S. PATENT DOCUMENTS

| | | | |
|---|---|---|---|
| 3,387,907 | 6/1968 | Wall | 308/3.6 X |
| 3,574,421 | 4/1971 | Stein | 308/3.8 |
| 3,574,437 | 4/1971 | Stein | 308/3.8 X |
| 3,778,946 | 12/1973 | Wood et al. | 29/155 R X |
| 3,973,814 | 8/1976 | Entrikin | 308/3.6 X |
| 4,119,377 | 10/1978 | Barber et al. | 308/3.6 X |
| 4,121,878 | 10/1978 | Lokken | 312/341 R |

*Primary Examiner*—Stuart S. Levy
*Assistant Examiner*—David Werner
*Attorney, Agent, or Firm*—Mark T. Basseches; Paula T. Basseches

[57] ABSTRACT

The present invention relates to a self-leveling drawer slide assembly. The assembly incorporates roller assemblies intended to be attached to the opposed faces of a cabinet and channel assemblies adapted to be affixed to the cabinet-adjacent faces of the drawer. The device of the invention is characterized in that the rollers are mounted on a short section and the channel assembly comprises a substantially longer section, the inner and outer ends of the channel section being inclined upwardly relative to a central horizontal section whereby, in the inner and outer limiting positions of the drawer, the tendency of the drawer to sag is counteracted by the tendency of the rollers to tilt the channels.

11 Claims, 7 Drawing Figures

SELF-LEVELING DRAWER SLIDE

BACKGROUND OF THE INVENTION

1. Field of the Invention

The present invention is in the field of drawer slide assemblies and pertains more particularly to an inexpensive drawer slide device which functions in a manner comparable to more expensive assemblies heretofore known.

2. The Prior Art

Conventional drawer slide assemblies include at each side of the drawer a roller mechanism adapted to be affixed to the opposed cabinet faces. A channel assembly is secured to the drawer sides, the channel assemblies being slidably supported on the roller mechanisms. Typically, both the roller assembly and the channel assembly extend approximately for the full depth of the drawer.

The roller assembly typically includes a roller adjacent the front of the cabinet, and the channel assembly a roller adjacent the rear of the drawer whereby the rear end of the drawer is continuously supported. In lieu of rollers there may be employed a multiplicity of ball bearings or like anti-friction members captured between the channel which moves with the drawer and the component affixed to the cabinet. The requirement that the roller assembly extend essentially the entire length of the drawer, with attendant high material costs, and the requirement that such assembly be fabricated, due to its length, by a relatively expensive rolling operation, materially increases the cost of the assembly.

Attempts have been made to provide an inexpensive drawer slide assembly consisting of an essentially conventional channel member. The expense saving is engendered by the provision of a short roller section intended to be mounted adjacent the front of the drawer opening, the roller section employing two relatively closely spaced roller members. While such assembly has proven feasible to a degree, there are numerous disadvantages associated therewith which have prevented its widespread use.

The principal disadvantage resides in the fact that, in the limiting positions of the drawer, i.e. the fully closed position and the fully open position, there is a tendency for the drawer to sag. More specifically, when the drawer is fully closed, since the two rollers engage the channel adjacent the front of the drawer, there is no support for the channel adjacent the inner end of the drawer. As a result, the inner end of the drawer tips downwardly and the front face of the drawer is thus disposed at an angle relative to the front face of the cabinet.

In the fully open position, an opposite condition results, i.e. the rollers engage the channels only at the inner end of the drawer and the eccentric weighting of the drawer makes the drawer tip such that the front end is lower than the back end.

SUMMARY

The present invention may be summarized as directed to an inexpensive drawer slide assembly which is self-leveling. The assembly includes a roller assembly adapted to be mounted to the cabinet adjacent the front face thereof, which roller assembly includes a spaced pair of rollers, the longitudinal displacement between the rollers being substantially less than the depth of the drawer and the length of the drawer channels.

The drawer channels are characterized in the provision of a generally horizontal section centrally located between upwardly inclined inner and outer end portions. In the fully withdrawn condition of the drawer at least one of the rollers lies within the upwardly inclined end portion of the channels whereby the channels are tilted in a direction such that the front end of the drawer is urged upwardly. In the fully closed condition of the drawer, at least one of the rollers engages within the upwardly inclined outer sections of the channels whereby the front of the drawer is urged downwardly and the rear of the drawer urged upwardly. In both circumstances the drawer, in its limiting positions, is thus prevented from assuming a sagging or tilted configuration.

It is accordingly an object of the invention to provide an inexpensive drawer slide assembly which includes a roller assembly and a channel assembly mounted for translatory movement of the rail assembly, which assembly holds the drawer in a manner resistant to sagging in its extreme positions.

Still a further object of the invention is the provision of an assembly of the type described employing a roller or glide assembly of short length mountable adjacent the front of the cabinet in combination with an elongate channel assembly having upwardly inclined inner and outer end portions. In the inner and outer limiting positions at least one roller of the roller assembly, by virtue of its engagement in the inclined portions of the channel assembly, stabilizes the drawer in an essentially horizontal or non-sagging condition.

To attain these objects and such further objects as may appear herein or be hereinafter pointed out, reference is made to the accompanying drawings, forming a part hereof, in which.

Figures 1, 2, 3, 7:
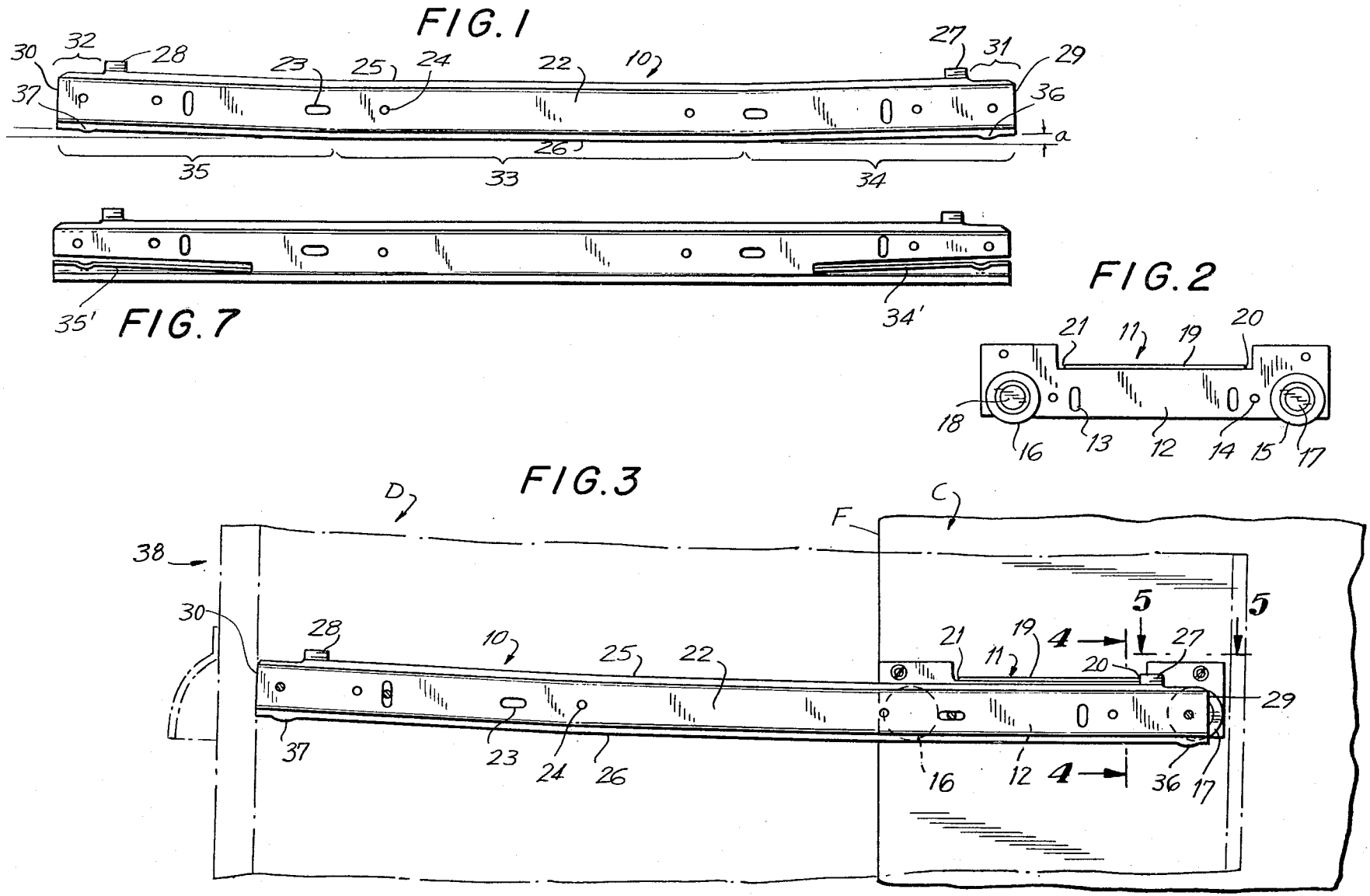
FIG. 1 is a side elevational view of a channel member in accordance with the invention.
FIG. 2 is a side elevational view of a roller assembly in accordance with the invention.
FIG. 3 is a side elevational view of a drawer mounted in the assembly in accordance with the invention in the outer limiting position of the drawer.
FIG. 7 is a side elevational view of a channel in accordance with an embodiment of the invention.
Figure 5:
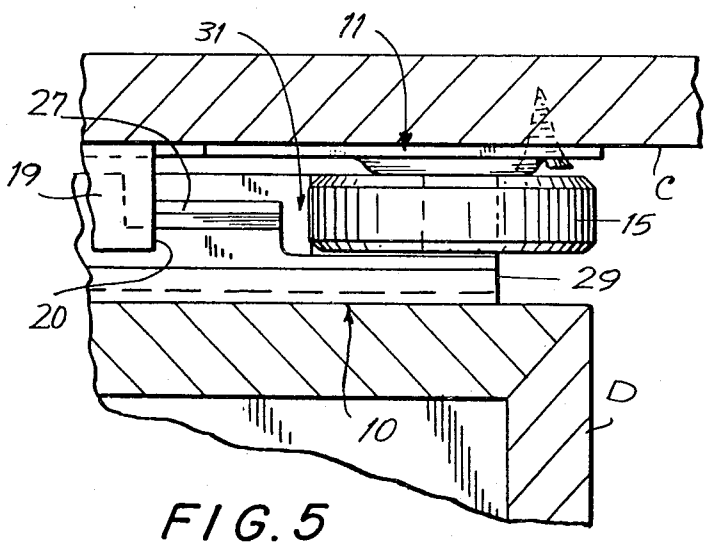
FIG. 5 is a magnified plan view taken in the direction of the arrows 5—5 of FIG. 3.

Referring now to the drawings, there is disclosed a drawer slide assembly which is comprised of a channel member 10 and a roller or glide assembly 11. The apparatus is applied to drawer D by affixing the roller assemblies 11 to the opposed walls of the cabinet C at a position adjacent the front F thereof. The channel members 10 are affixed to the sides of the drawer D.

The roller assembly 11 may comprise a mounting plate 12 having a plurality of through-going apertures, e.g. 13, 14, for the reception of mounting screws, bolts or the like. A pair of roller members 15, 16 are rotatably secured to the plate 12 on axles 17, 18, respectively, which axles extend in a horizontal plane perpendicular to the plate 12.

The roller assembly may include an offset flange 19, the opposed ends 20, 21 of which coact with portions of the channel assembly next to be described, to define inner and outer limit stops controlling the movements of the drawer.

Figure 4:
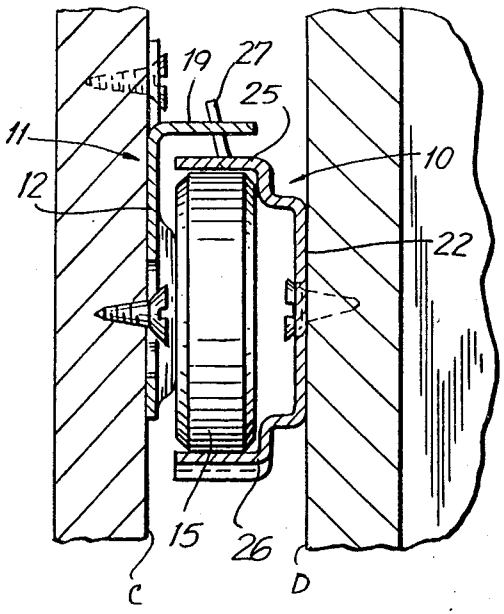
FIG. 4 is a magnified vertical section taken on the line 4—4 of FIG. 3.

The channel assembly 10 is generally U-shaped in transverse section (see FIG. 4), including a central branch 22 which functions as a mounting plate, the central branch including a plurality of mounting apertures 23, 24, etc. The channel 10 includes an upper track portion 25 and a lower track portion 26 which extend generally horizontally, it being understood that the rollers 15, 16 ride in the space between the said tracks.

The channel assembly 10 may include upwardly projecting lugs 27, 28 adjacent the opposed ends 29, 30 thereof, which coact with the ends 20, 21 of the flange 19 of the roller assembly to define inner and outer limit stops.

Preferably, the upper track 25 adjacent its inner and outer ends 29, 30 is cut away in the areas 31, 32 to provide clearance for mounting the track to the roller assembly in a manner hereinafter described.

A characterizing feature of the invention resides in the configuration of the track 10 which includes a central, generally horizontal running portion 33, an upwardly inclined inner end portion 34, and an upwardly inclined outer end portion 35.

It will be understood that the channel member 10 and also the roller assembly are preferably formed such as to be symmetrical about their central transverse axes and thus useable at either side of the drawer. Accordingly, it will be recognized that what is referred to as the inner end portion in FIG. 1 will, if the track section is used on the opposite side or hand of a drawer, form the outer end portion.

The channel member 10, in the lower track section thereof, includes inner and outer retaining detents 36, 37, respectively. The angle A (FIG. 1) between the runner section 33 and the inner and outer sections 34, 35, respectively, may vary in accordance with the intended carrying capacity of the slide assembly. A 3° angle has been found satisfactory for normal applications although, as noted above, the angular offset may be varied in accordance with the intended application.

It will further be observed by comparison of FIGS. 1 and 2 that the longitudinal spacing of the rollers 15, and 16 is substantially less than the length of the channel 10 and is normally less than one half of the total translatory movement extent of the channel relative to the cabinet. As will be appreciated, the translatory movement is a function of the spacing of the stop lugs 27, 28 and the longitudinal extent of the flange 19.

Figure 6:
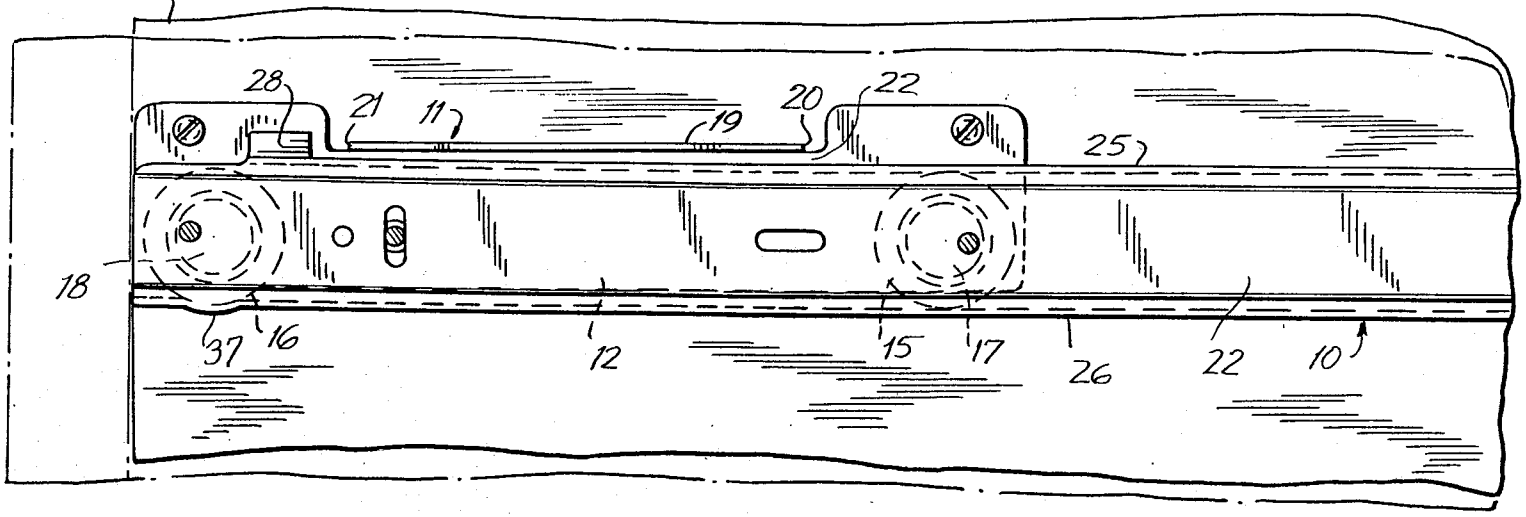
FIG. 6 is a view similar to FIG. 3 showing the position of the parts in the closed condition of the drawer.

The operation of the device will be apparent from the preceding description, with particular reference to FIGS. 3 and 6.

In the fully extended position of the drawer shown in FIG. 3, the inner roller 15 will lie within the inclined section 34 and the outer roller 16 will lie either within the section 34 or, preferably, within the terminal end portion of the horizontal runner section 33. When the drawer is in the disposition shown in FIG. 3, the rollers induce a clockwise turning moment to the channel section 10 due to the inclination of section 34, which turning moment would tend to lift the front end 38 of the drawer. This turning moment counteracts the natural tendency of the extended drawer to pivot in an anti-clockwise direction. The drawer is thus maintained in an essentially horizontal position or, if the weight load within the drawer is not substantial, in a slight upwardly inclined condition.

The eccentric weight load of the drawer will cause the detent 29 to be seated over the lower circumference of the inner roller 15 and support the drawer in its outward or extended position, counteracting any tendency of the drawer to move inwardly as a result of upward forces of the lower track against the roller 15.

In FIG. 6 the track is shown in its fully closed position. In such condition the outer roller 16 enters into the outer inclined surface 35, inducing an anti-clockwise moment in the drawer and combatting the natural tendency of the inner end of the closed drawer to sag downwardly. In such closed position, the eccentric weight distribution of the drawer causes the outer detent 37 to be forced upwardly against the lower periphery of the roller 16, whereby the drawer is detented against a tendency to roll outwardly to a partial ajar condition.

As will be apparent from the preceding description, insertion of the drawer into position is effected by tilting the drawer such that the inner end of the drawer is lower than the front of the drawer. In this position the inner stop 27 may be passed to a position below flange 19 and the drawer moved inwardly until the stop 27 lies behind the inner end 20 of the flange. The clearance area 31 in the upper track 35 permits the drawer to be tilted to its horizontal position, providing clearance for the movement of roller 15 to a position in horizontal registry with the space between tracks 25 and 26.

The embodiment of FIG. 7 discloses a channel configuration wherein the tilting action is effected by the provision of inner and outer ramps 34' and 35'. It will be readily recognized that in all other respects the channel section of FIG. 7 is identical to that of FIG. 1, the necessary tilting action being effected by ramps rather than by a bending or inclination of the entire channel.

The benefits of the instant invention may be realized by a construction wherein the channel assembly is comprised of inclined sections which extend to the center, i.e. wherein there is no central runner section but the channel is bent upwardly to both sides of the center.

As will be appreciated from the preceding description. there is provided in accordance with the present invention a simple and inexpensive drawer slide assembly utilizing a short roller section having relatively closely spaced rollers which, despite the proximate spacing of the rollers, functions to support a drawer in a substantially level condition in both the inner and the outer limiting positions of the drawer.

A further advantage of the device resides in the detenting action achieved as a result of the combined effect of the turning moment imparted to the drawer and the provision of detents or recesses occupied by the roller in the limiting positions of the drawer.

The device of the invention is substantially less expensive to produce than conventional full length drawer slide assemblies and yet the undesirable tendency of drawers to sag, experienced with inexpensive assemblies heretofore known, is avoided in accordance with the instant invention.

Numerous variations may occur to those skilled in the art and familiarized with the instant disclosure. Accordingly, the invention is to be broadly construed within the scope of the appended claims

Having thus described the invention and illustrated its use what is claimed as new and is desired to be secured by Letters Patent is:

1. A self-leveling drawer slide assembly comprising a pair of channel members adapted to be mounted to the sides of a drawer and a pair of roller assemblies adapted to be mounted to the drawer-adjacent faces of a cabinet, said channel members being generally U-shaped in transverse section and including a vertically directed branch portion and upper and lower horizontal track portions, said roller assemblies including a horizontally spaced-apart pair of roller members adapted to ride between said track portions and support said upper track for translatory movement between inner and outer limiting positions corresponding, respectively, to the closed and opened positions of said drawer, the horizontal distance between said rollers being generally of the order of about one half or less the length of said track members, said channels including a generally level central portion and at least one end portion inclined upwardly from said central portion, said inclined end portion, in one said limiting position being in registry with at least one said roller of each said roller assembly, said roller assemblies and inclined portions being positioned to coact in said one limiting position bodily to pivot the end of the channel member remote from said at least one end portion in an upward direction, thereby to counteract the tendency of said drawer to sag.

2. A drawer slide assembly in accordance with claim 1 wherein both end portions of said channels are upwardly inclined relative to said central portion, each said inclined portion being in registry with at least one roller of each said roller assembly in each of said limiting positions, each of said inclined portions being positioned, when in registry with a said roller assembly, to coact with said roller assemblies bodily to pivot the end of the channel member remote from said roller assemblies in an upward direction.

3. A slide assembly in accordance with claim 2 wherein at least one of said inclined portions of said channels is defined by ramp portions.

4. A slide assembly in accordance with claim 3 wherein said ramp portions are formed on said lower track portions.

5. A drawer slide assembly in accordance with claim 1 and including detent means in said lower track portion of said inclined portion of said channel, said detent means being positioned to coact with said roller assembly at said one limiting position, thereby to resist movement of said at least one roller out of said inclined portion of said track.

6. A drawer slide assembly in accordance with claim 5 wherein said lower track portion of said detent means comprises a recess formed in said inclined portion of said channel, said recess being positioned to engage said at least one roller.

7. A self-leveling drawer slide assembly comprising a pair of channel members adapted to be mounted to the sides of a drawer and a pair of roller assemblies adapted to be mounted to the drawer-adjacent faces of a cabinet, said channel members being generally U-shaped in transverse section and including a vertically directed branch portion and upper and lower horizontal track portions, said roller assemblies including a horizontally spaced-apart pair of roller members adapted to ride between said track portions and support said upper track for translatory movement between inner and outer limiting positions corresponding, respectively, to the closed and opened positions of said drawer, the horizontal distance between said rollers being generally of the order of about one half or less the length of said track members, said channels including a generally level central portion and end portions inclined upwardly from said central portion, the inclined end portions at one end of said channels being in registry with said roller assembly at one said limiting position, and the inclined end portions at the other end of said channels being in registry with said roller assembly in the other said limiting position, at least one roller of each said roller assembly being disposed within said inclined portions in each of said limiting positions, said roller assemblies and inclined portions being located to coact at said limiting positions bodily to pivot the ends of said channel members remote from said roller assemblies in an upward direction, thereby to counteract the tendency of said drawer to sag.

8. A drawer slide assembly in accordance with claim 7 and including detent means on said lower track portions of said channels positioned to coact with portions of said roller assemblies in said limiting positions, thereby to resist relative movement of said channels and roller assemblies from said limiting positions.

9. A drawer slide assembly in accordance with claim 8 wherein said detent means comprises recesses formed in said lower track at said inclined portion of said channels, said recesses being positioned to engage said at least one roller at said limiting positions.

10. A drawer slide assembly in accordance with claim 7 wherein at least one of said inclined portions is defined by ramps formed on said lower track portions.

11. A self-leveling drawer slide assembly comprising a pair of channel members adapted to be mounted to the sides of a drawer and a pair of roller assemblies adapted to be mounted to the drawer-adjacent faces of a cabinet, said channel members being generally U-shaped in transverse section and including a vertically directed branch portion and upper and lower horizontal track portions, said roller assemblies including a horizontally spaced-apart pair of roller members adapted to ride between said track portions and support said upper track for translatory movement between inner and outer limiting positions corresponding, respectively, to the closed and opened positions of said drawer, the horizontal distance between said rollers being generally of the order of about one half or less the length of said track members, said channels including end portions inclined upwardly from the longitudinal center of said track, the inclined end portions at one end of said channels being in registry with said roller assembly at one said limiting position, and the inclined end portions at the other end of said channels being in registry with said roller assembly in the other said limiting position, at least one roller of each said roller assembly being disposed within said inclined portions in each of said limiting positions, said inclined portions and roller assemblies being positioned to coact in said limiting positions bodily to pivot the ends of said channels remote from said roller assemblies in an upward direction, thereby to counteract the tendency of said drawer to sag.

* * * * *